US006267825B1

(12) United States Patent
Stall et al.

(10) Patent No.: US 6,267,825 B1
(45) Date of Patent: Jul. 31, 2001

(54) PROCESS FOR TREATING METAL WORKPIECES

(75) Inventors: Thomas C. Stall, North Grosvenordale, CT (US); Kevin R. Fleury, Feeding Hills, MA (US); Craig A. Mariani, Ludlow, MA (US); Brett Curry, Chicopee, MA (US); Michael J. Poulin, Granby, MA (US)

(73) Assignee: Smith & Wesson Corp., Springfield, MA (US)

( * ) Notice: Subject to any disclaimer, the term of this patent is extended or adjusted under 35 U.S.C. 154(b) by 0 days.

(21) Appl. No.: 09/174,154

(22) Filed: Oct. 16, 1998

(51) Int. Cl.[7] ..... C23C 8/06

(52) U.S. Cl. ..... 148/237; 148/237; 148/316; 148/317; 148/669; 428/610

(58) Field of Search ..... 148/237, 316, 148/317, 669; 428/610

(56) References Cited

U.S. PATENT DOCUMENTS 2,892,743 * 6/1959 Griest et al. ..... 148/237
5,466,305 * 11/1995 Sato et al. ..... 148/222

* cited by examiner

*Primary Examiner*—John Sheehan
*Assistant Examiner*—Andrew L. Oltmans
(74) *Attorney, Agent, or Firm*—McCormick, Paulding & Huber LLP

(57) ABSTRACT

A method for treating metal workpieces, including non-ferrous metal workpieces such as Titanium. The metal workpieces are heat soaked for a predetermined amount of time in a furnace at a predetermined temperature. An interstitial element is introduced into the area adjacent to the surface of the metal workpieces until a predetermined concentration of the interstitial element exists in the area adjacent to the metal workpieces. The treated metal workpieces are then cooled, resulting in the metal workpieces having a diffusion region formed which extends into the body of the metal workpieces. The region has a gradient of the interstitial element formed therein.

8 Claims, 3 Drawing Sheets

| | Extra Low Interstitial Titanium | Standard | REM Deburring | Finish | Acetone Cleaning | Electro Chemical Cleaning | Furnace | Temperature | Quenching Medium | Grit Bla | Non Grit Bla | Results | |
|---|---|---|---|---|---|---|---|---|---|---|---|---|---|
| | | | | | | | | | | | | Good | Bad |
| 1 | √ | | √ | √ | | √ | VAC | 1700° | OIL | | √ | √ | |
| 2 | | √ | √ | √ | | √ | CARB | 1500° | AIR | √ | | √ | |
| 3 | √ | | √ | √ | | √ | CARB | 1500° | AIR | √ | | √ | |
| 4 | | √ | √ | √ | √ | | BELT | 1500° | AIR | √ | | | √ |
| 5 | | √ | √ | √ | | √ | BELT | 1400° | AIR | √ | | | √ |
| 6 | | √ | √ | √ | √ | | BOX | 1400° | AIR | √ | | | √ |
| 7 | | √ | √ | √ | √ | | BOX | 1350° | AIR | √ | | | √ |
| 8 | | √ | √ | √ | √ | | CARB | 1500° v/pic5 | AIR | √ | | √ | |
| 9 | √ | | √ | √ | | √ | VAC | 1700° | OIL | Sides only | | √ | |
| 10 | √ | | √ | √ | | √ | CARB | 1500° v/pic5 | AIR | Sides only | | √ | |

FIG. 4

PROCESS FOR TREATING METAL WORKPIECES

FIELD OF THE INVENTION

This invention relates in general to a process for treating metal workpieces, and deals more particularly with a process by which a non-ferrous metal workpiece is heat treated in combination with an interstitial element, the resultant non-ferrous metal workpiece thereby exhibiting a high degree of stress resistance.

BACKGROUND OF THE INVENTION

There has long been a great demand for strong yet lightweight metal products covering a wide range of diverse arts. The manufacture of guns, and in particular handguns, having such a resilient lightweight metal structure has been especially troublesome given the localized stresses involved when the handgun is fired. There presently exists a need to produce a lightweight handgun for those individuals, such as law enforcement personnel, who are forced out of necessity to carry handguns continuously for long periods of time. Metals and associated alloys such as Aluminum and stainless steel are known materials for the manufacture of handguns, such as those manufactured by Smith and Wesson, assignee of the present invention. A process for heat treating these metals and associated alloys for use in handguns is also known in the art.

In a known process for heat treating metal handgun parts, the parts are placed in a furnace and subjected to high temperatures. Handguns made in this way still have, due to the particular metals currently used, a weight which is detrimental to a user, especially in the larger caliber handguns currently on the market and desired by law enforcement personnel.

Other non-ferrous metals, such as Titanium, are commonly utilized in bio-medical and aircraft structures for its inherent strength and lightweightness. While Aluminum typically has a strength of 78–80 KSi, that is Aluminum can withstand up to 78–80 thousands of pounds of pressure per square inch before failing, Titanium has a KSi of around 135. Given Titanium's advantage over Aluminum in this respect, and the fact that it is even lighter than Aluminum, Titanium is an ideal prospect for use in, among other fields, handgun manufacture.

The problem with the construction of handguns using Titanium as a material is that, when formed as a barrel and cylinder combination, Titanium exhibits an undesirable amount of erosion and spauling on its cylinder surface after exposure to repeated firings of ammunition rounds. This is due in large part to Titanium being a relatively porous material compared to other metals, and thereby being especially sensitive to these stresses.

Another problem with the use of Titanium in handgun design is that, in the heating process, there is sometimes formed what is known in the art as an Alpha layer upon the surface of the Titanium. An Alpha layer is a normally detrimental thin oxide layer formed on Titanium through the interaction of various interstitial elements, typically $N_2$, $O_2$ or $H_2$, with the porous surface of the Titanium.

With the forgoing problems and concerns in mind, it is the general object of the present invention to provide a process for the treatment of metal workpieces, such as those made from Titanium, which overcomes the above-described drawbacks, as well as to affirmatively use Titanium workpieces in the manufacture of large caliber handguns.

SUMMARY OF THE INVENTION

It is an object of the present invention to provide a process for treating a metal workpiece. The process includes heating the metal workpiece to a predetermined temperature for a predetermined amount of time, and introducing a predetermined concentration of an interstitial element in the area adjacent to the surface of the metal workpiece as the metal workpiece is heated, so as to produce a region of diffused interstitial element extending into the body of the metal workpiece.

A preferred embodiment of the present invention also includes the use of non-ferrous metal workpieces, such as a Titanium workpiece. The non-ferrous workpiece is prepared, with particular attention to cleaning the surfaces thereof. This cleaning can be accomplished using an ultrasonic or electro-chemical cleaning method. The cleaned non-ferrous metal workpieces are then placed within a furnace while Carbon is added in a defined quantity to act as an interstitial element. The non-ferrous metal workpieces are heat soaked for a predetermined amount of time at a predetermined temperature. Finally, the treated non-ferrous metal workpieces are then air cooled and the resultant workpieces exhibit a far superior resistance to tensile stresses than has heretofore been perceived.

Preferably, the heat treatment of the non-ferrous metal workpieces enables a diffusion process to affect the body of the non-ferrous metal workpieces whereby interstitial Carbon atoms are diffused into the body of the non-ferrous metal workpieces. This diffusion of Carbon atoms does not create a defined outer layer, such as an Alpha layer, but rather extends some distance below the surface area of the non-ferrous metal workpieces, infusing the body of the non-ferrous metal workpieces with interstitial Carbon atoms.

In a preferred operation, the treatment process is particularly useful in the manufacture of lightweight guns which experience repeated, localized exposure to high tensile stresses, and where failure of the operable part would be extremely dangerous and undesirable. Use of this process is not, however, limited in this regard, as many other uses of non-ferrous metal workpieces so produced can be envisioned in many diverse arts.

These and other objectives of the present invention, and their preferred embodiments, shall become clear by consideration of the specification, claims and drawings taken as a whole.

BRIEF DESCRIPTION OF THE DRAWINGS

FIG. 4 is a data chart showing various trials of the treating process of the present invention.

DETAILED DESCRIPTION OF THE PREFERRED EMBODIMENT

Figure 1:
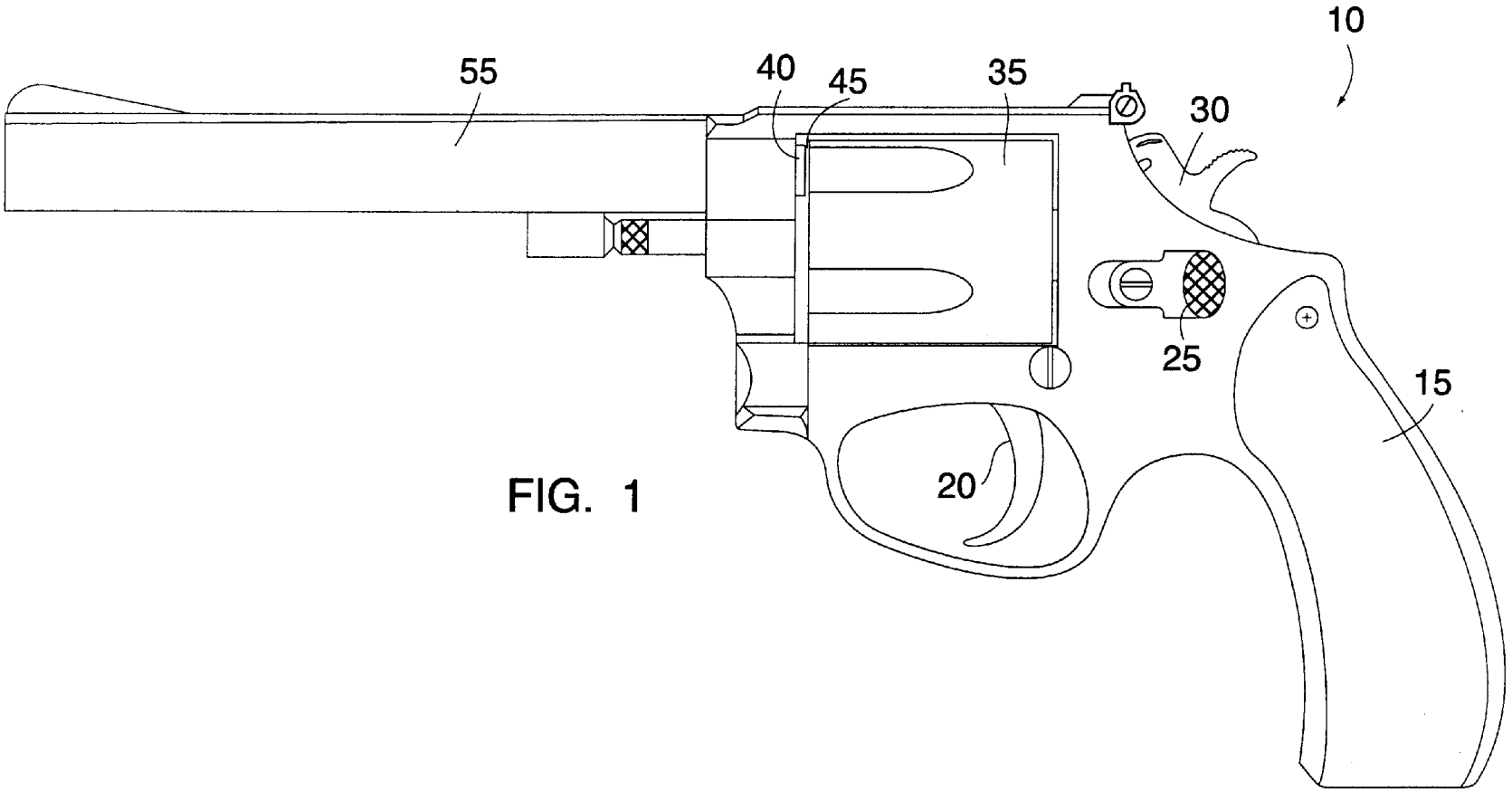
FIG. 1 is a simplified schematic illustration of a Titanium revolver, in accordance with one embodiment of the present invention.

As shown in FIG. 1, a revolver handgun in accordance with an embodiment of the present invention is generally designated by numeral 10 and includes a body 50 and a barrel 55. A handle 15, a trigger 20, a safety 25 and a hammer 30 are commonly known elements which together act in a well known manner to facilitate the firing of rounds from the revolver 10.

Figure 2:
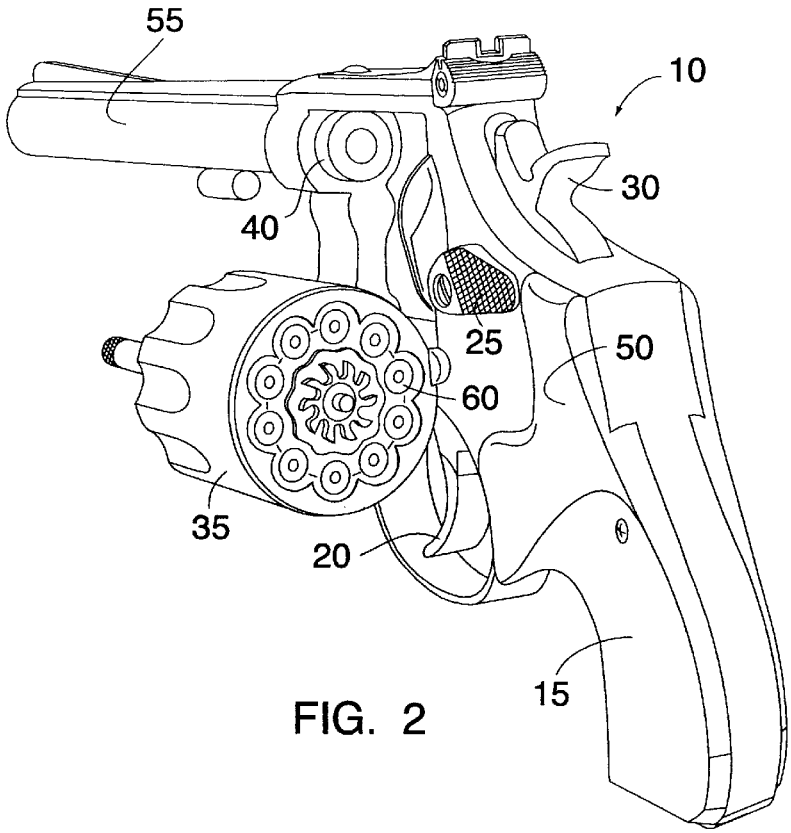
FIG. 2 is a simplified schematic illustration of the Titanium revolver of FIG. 1 with the cylinder being at a disengaged position.

The revolver 10 is formed from the assembly of non-ferrous metal workpieces, such as Titanium, which have been treated in a process to be described later, and further defines an opening in the body 50 within which a cylinder 35 is selectively seated. The cylinder 35 typically holds a plurality of rounds that will face a nested, extended bore 40 of the barrel 55 when in position to be fired. The revolver 10 is manufactured so as to leave a small barrel-cylinder (BC) space 45 between the nested, extended bore 40 and the front face of the cylinder 35 when the cylinder 35 is selectively moved to its operative position. The BC space 45 is typically on the order of several hundreds of an inch. FIG. 2 illustrates in greater detail the nested, extended bore 40 as well as a plurality of center fire 0.357" caliber rounds 60 received in the cylinder 35. The revolver 10 shown in FIGS. 1 and 2 of the present embodiment is crafted to operate with the 0.357" caliber rounds 60, but is not limited in this regard as handguns of differing, including larger, calibers may also be crafted without departing from the broader aspects of the present invention. Additionally, while Titanium metal workpieces have been described, the present invention is not limited in this regard either as alternative non-ferrous metals exhibiting similar atomic or chemical characteristics as Titanium may be used without departing from the broader aspects of the present invention.

As was briefly discussed in the Background of the Invention, previous attempts at crafting a handgun from Titanium resulted in unsuccessful structures due to the severe erosion of the cylinder surface in the area surrounding the BC space 45. This erosion occurs when a round 60 is fired subjecting the BC space 45, as well as the nested, extended bore 40 and the cylinder 35, to a combination of hot gases, unvaporized particles and flame. In previous attempts at crafting Titanium handguns of this type, the porous surface of the Titanium cylinder 35 was undesirably affected by this abusive combination of gas and particles and quickly became eroded and scored, leading to fractional spauling and operational failure of the revolver 10 as a whole.

Applicants have attempted to solve this problem by subjecting Titanium workpieces of the revolver 10 to intense heat within a vacuum furnace. These workpieces were then put through a solution annealing process, also within a vacuum, and subsequently air cooled. The resultant Titanium workpieces did possess slightly better stress resistance, exhibiting a range of performance with respect to the erosion and scoring effects. At the time it was believed that this increased resistance to stresses was due to an Alpha layer, having a Rockwell hardness of approximately 65, formed on the surface of the Titanium workpieces resulting from contact with Oxygen when the Titanium workpieces were air cooled. Further attempts at creating an even greater, that is, thicker, Alpha layer so as to hopefully provide greater resistance to stresses were ultimately unsuccessful. It was found that while a thicker Alpha layer slightly increased the stresses the Titanium workpieces could withstand over the short term, failure inevitably occurred. Moreover, when a Titanium workpiece having a thicker Alpha layer failed, the fractional spauling that the surface of the workpiece experienced was correspondingly greater in magnitude, as the porous Titanium material beneath the thicker Alpha layer was subjected to greater stresses than with a thinner Alpha layer.

Applicants then experimented with other interstitial elements, that is, atoms or ions of usually non-metal elements which occupy the spaces between larger, usually metal, atoms or ions in a crystal lattice, commonly utilized with Titanium to attempt to see if their introduction would create an Alpha layer, of varying thicknesses, which would avoid the problems associated with erosion and spauling. Towards this end, Applicants have found that the introduction of Hydrogen as an interstitial element made the resulting Titanium workpieces too brittle. Also, when Nitrogen was utilized, similar failings of erosion and spauling occurred, as well as having a temperature related problem. It was found that in order to introduce Nitrogen into the Titanium workpieces, temperatures around 1900° F. were required. At these temperatures, the Titanium workpieces themselves experienced structural deformation which rendered them functionally unusable.

Figure 3:
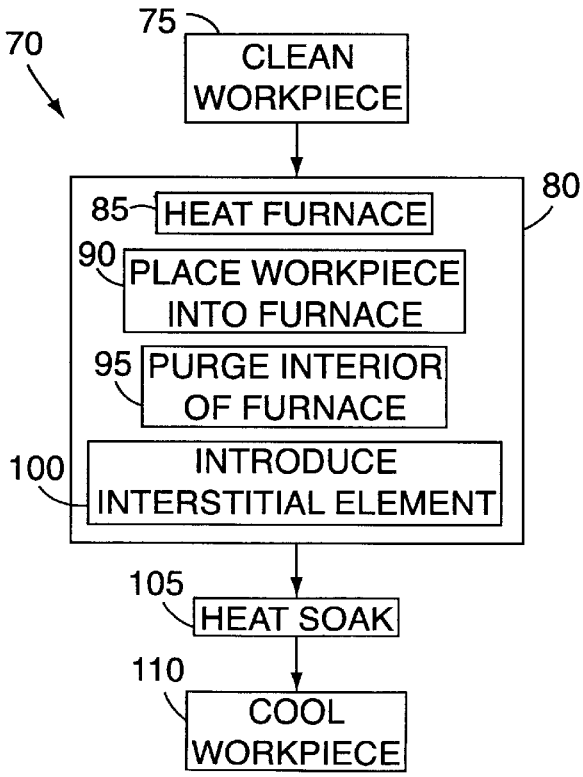
FIG. 3 is a flow diagram showing an embodiment of the heat treating process of the present invention.

A preferred embodiment of the process for treating metals, including Titanium or other non-ferrous metals, according to the present invention as illustrated in the algorithm 70 of FIG. 3, serves to address both the problems associated with erosion and spauling of the Titanium workpiece surface, as well as temperature and Alpha layer concerns. In this preferred embodiment, a 6Al 4V ELI (Extra Low Interstitial) type Titanium was utilized, as such a Titanium is readily available and widely used for many diverse applications. While a 6Al 4V ELI type Titanium is described, the present invention is not limited in this regard as it should be readily apparent that any Titanium corresponding to a particular use or device would also suffice without departing from the broader aspects of the present invention.

Titanium is first machined into, for example, the constituent workpieces of a revolver handgun 10. These workpieces are then subjected to a cleaning process 75, as shown in FIG. 3, either through ultra-sonic or electro-chemical cleaning. Applicants have discovered that cleaning in this manner, followed by careful handling of the cleaned workpieces so as to ensure no contact between the cleaned Titanium workpieces and human skin, is advantageous in two respects. Firstly, any contaminate located upon the surface of the Titanium workpieces, such as oils from human contact, will impede somewhat the diffusion process to be described shortly; and secondly, handling in this respect ensures that the resultant Titanium workpieces will exhibit a uniform, similar coloring—typically a slate gray—which would not result if either the cleaning or careful handling of the workpieces were not observed. While ultra-sonic or electro-chemical cleaning has been described, the present invention is not limited in this regard as it will be readily appreciated that an alternative cleaning process may be employed without departing from the broader aspects of the present invention. In addition, multiple cleaning processes may be applied, one after the other, to the workpieces. FIG. 4 illustrates this point by showing a sampling of trials conducted with workpieces where the workpieces were subjected to REM deburring as well as, in some cases, acetone cleaning prior to being placed in a furnace.

FIG. 3 further illustrates a following step 80 in the process of the present invention and involves the sub-step 85 of heating a furnace to a predetermined temperature. In sub-step 90 the Titanium workpiece is placed into the furnace. In a preferred embodiment, the furnace is a Carburize furnace heated at approximately one atmosphere of pressure. The Carburize furnace is then purged in sub-step 95 of all extraneously existing interstitial elements by a positive pressure introduction of ($N_2$) Nitrogen. This is done to ensure that no interstitial elements such as Oxygen or Hydrogen are present within the furnace, thereby effectively preventing the formation of an Alpha layer upon the surface of the Titanium workpieces as well as preventing the recreation of the aforementioned problems. While Nitrogen itself can be an interstitial element, $N_2$ will not act as such in this embodiment of the present invention, as it would be incapable of being absorbed by the Titanium surface. In order for $N_2$ to act as an interstitial element, it must first crack to enable absorption, that is, it must first be split into atomic (N) Nitrogen. This cracking only occurs at temperatures approaching 1900° F., several hundreds of degrees higher than the operational temperature of the present invention, as will be discussed below. While the introduction of (N2) Nitrogen to purge the furnace of extraneous interstitial elements has been described, the present invention is not limited in this regard. Applicants has discovered that although the heat treating process of the present invention works best when this purging is done, substantial benefits to the finished Titanium workpieces can also be derived without such a purging.

Sub step 100 of FIG. 3 illustrates the purposeful introduction of a predetermined amount of an interstitial element into the Carburize furnace while the Titanium workpieces are being subjected to the predetermined temperature. In a preferred embodiment of the present invention, Carbon is utilized as the interstitial element.

The next step 105 in the process of the present invention is to allow the Titanium workpieces to heat soak at the predetermined temperature for a predetermined amount of time. Subsequent step 110 illustrates the cooling of the workpieces until ambient temperature is reached.

An Alpha layer is not formed during the time the Titanium workpieces are heat soaked. Rather, the Carbon in the furnace environment diffuses into the Titanium workpieces to form an inundated region extending into the body of the Titanium workpieces, the region having a logarithmic gradient of interstitial Carbon formed therein.

In the above described algorithm 70, the type of furnace utilized, the pressure within the furnace, the temperature at which the furnace is operated, the amount of interstitial Carbon introduced to the process and the time the workpieces are allowed to heat soak are all interrelated variables. As was discussed above, in a preferred embodiment of the present invention, the furnace is a Carburize furnace operating at one atmosphere. FIG. 4 shows four successful trials, trials 2, 3, 8 and 10, conducted with a Carburize furnace. Successful applications of this process utilizing such a Carburize furnace include heating to a preferred range between approximately 1400° F. and 1700° F. A most preferred temperature of the Carburize furnace is approximately 1500° F. At temperatures much below 1400° F., the grains of the Titanium workpiece do not open enough to allow effective diffusion of the interstitial Carbon to occur, while at temperatures much above 1700° F., structural phase changes of the Titanium workpieces are observed. It should be readily apparent that changes in atmospheric pressure within the Carburize furnace will result in corresponding alterations in the operating temperature of the Carburize furnace. As a general rule, the higher the internal pressure of the Carburize furnace goes, the lower the temperature needs to be to accomplish successful interstitial Carbon diffusion in accordance with the present invention.

FIG. 4 illustrates, in trials 1 and 9, that successful results have also been obtained in trials utilizing a vacuum furnace as well. The heating of a vacuum furnace is done in a preferred range between approximately 1600° F. to 1850° F., with a most preferred temperature of approximately 1700° F. It should be noted that when utilizing a vacuum furnace, interstitial Carbon may be introduced as in the Carburize furnace discussed above. Similar results, however, can be obtained utilizing a vacuum furnace without the introduction of interstitial Carbon per se, by adding an additional step of quenching the heated Titanium workpieces in oil. In this variation, Carbon is diffused into the Titanium workpieces by the virtually instantaneous conversion of hydrocarbons within the oil as the oil strikes the heated surfaces within the vacuum furnace.

The time that the workpieces are allowed to heat soak is primarily a function of the temperature of the furnace. A preferred heat soak time range is between approximately 10 minutes to approximately 3 hours, a more preferred heat soak time range is between approximately 20 minutes to approximately an hour and a most preferred heat soak time of approximately 45 minutes has seen successful results. The present invention, however, is not limited in this regard as differing heat soak times are also contemplated by the present invention. The depth of diffusion of the interstitial Carbon into the body of the Titanium workpieces, although dependent upon the heat soak time, is not linear. While several thousandths of an inch of diffusion penetration occurs approximately within the first 45 minutes, the additional heat soak time extending to 2 or 3 hours achieves only marginal additional depths. For instance, since it has been discovered that a longer heat soak time will result in a greater and deeper concentration of diffused interstitial Carbon within the Titanium workpieces, the actual heat soak time will be dependent upon, among other factors, the specific application for which the workpiece is to be eventually used.

A major aspect of the present invention is the amount of interstitial Carbon added to the Carburize furnace. As discussed above in conjunction with the vacuum furnace, even the marginal amounts of Carbon picked up from the oil in a quenching process will serve to provide beneficial results. In a preferred embodiment utilizing a Carburize furnace, however, Carbon is preferably added at a concentration of between approximately 0.010% to 0.85%, a more preferred concentration of between approximately 0.05% to 0.50% and a most preferred concentration of approximately 0.10%. Concentrations exceeding 0.85%–0.95% have been found to give lesser benefits as the Titanium workpieces exhibit carbide buildup and carbide networking leading to cracking in the finished product. The concentrations of interstitial Carbon are regulated in a manner known in the art by the use of a probe within the furnace enclosure. As a supply of liquid Carbonic fluid is dripped into the furnace enclosure, the probe senses the concentration of Carbon released and halts the dripping of Carbonic fluid at a time corresponding to the required concentration. While a liquid supply of Carbonic fluid has been described, the present invention is not limited in this regard as alternative methods of supplying the interstitial element to the furnace enclosure without departing from the broader aspects of the present invention.

The use of a Carburize furnace, or any furnace capable of similar temperature and Carbon releasing capabilities, and the purposeful introduction of Carbon to act as an interstitial element, are major aspects of the present invention. The use of Carbon as an interstitial element has only been practiced in conjunction with ferrous metals. It has been noted previously that Titanium, not a ferrous metal, is commonly used in, among other fields, bio-medical devices as well as in aircraft design. In fact, the interaction of Carbon with previously known Titanium products has traditionally been considered a detriment, the interstitial Carbon acting as a contaminant of these Titanium products. As Titanium is not a ferrous metal, there has not been any justification or incentive in prior metallurgy arts to purposefully utilize interstitial Carbon when crafting Titanium products and, therefore, the use of a Carburize furnace in this manner is heretofore unknown.

Applicants have found, however, that the diffusionary effect of interstitial Carbon into the body of affected Titanium workpieces significantly increases the tensile strength of these workpieces, and makes them especially useful in fields requiring lightweight and high stress resistant products, such as in handgun designs. In particular, Applicant's has discovered that when a handgun, such as the 0.357" caliber revolver 10 of FIGS. 1 and 2, has been formed from Titanium having been treated so as to have regions of interstitial Carbon, thousands of rounds may be fired from such a revolver without experiencing the noticeable erosion or spauling apparent in previous attempts at manufacturing Titanium handgun structures. Moreover, larger caliber handguns, which create even larger stressing forces, may now be designed giving these heavier handguns the lightweight and stress resistant aspects which have long been sought after.

In step 110 of the present invention as shown in FIG. 3, the heated Titanium workpieces are allowed to cool for a time until they reach ambient temperature. Any Alpha layer formed during, for instance, air cooling due to the Oxygen in the air is negligible and does not seriously detract from the above mentioned advantages.

Although the present invention has been described in conjunction with handgun design, it is an important aspect of the present invention that the disclosed heat treatment of Titanium and other non-ferrous metal workpieces may be applied to a wide range of differing arts. That is, the specific design of the Titanium workpiece is secondary to the underlying discovery of a treatment of Titanium which makes Titanium's use in structures exposed to high stresses newly possible.

As can be seen by the foregoing discussion, Applicants have discovered that the formation of a hard Alpha layer, of whatever thickness, on the surface of a Titanium workpiece is not especially important, does not solve the problems of erosion or fractional spauling and does, in fact, exacerbate failure of the Titanium workpiece when it occurs. Rather, it is by the formation of a Titanium workpiece having a region imbued with a gradient amount of diffused interstitial Carbon that increases the tensile strength of the Titanium workpiece and, with respect to handgun design, effectively prevents the occurrence of erosion and fractional spauling in the localized areas repeatedly subjected to high explosive stress.

While the invention had been described with reference to the preferred embodiment, it will be understood by those skilled in the art that various obvious changes may be made, and equivalents may be substituted for elements thereof, without departing from the essential scope of the present invention. Therefore, it is intended that the invention not be limited to the particular embodiments disclosed, but that the invention includes all embodiments falling within the scope of the appended claims.

What is claimed is:

1. A method for treating a non-ferrous metal workpiece, said method comprising the steps of:

cleaning said non-ferrous metal workpiece using one of an ultra-sonic or electro-chemical cleaning process;

heating said cleaned non-ferrous metal workpiece in a furnace pressurized to approximately 1 atmosphere, said furnace being heated to approximately 1400° F. to approximately 1700° F.; and introducing an interstitial element into said furnace in an area adjacent said non-ferrous metal workpiece, wherein a diffusion region is formed extending into said non-ferrous metal workpiece having a gradient of said interstitial element formed therein.

2. The method for treating a non-ferrous metal workpiece as defined in claim 1, wherein:

said non-ferrous metal workpiece comprises one of a titanium and a titanium-alloy workpiece.

3. The method for treating a non-ferrous metal workpiece as defined in claim 1, wherein:

the interstitial element is Carbon.

4. The method for treating a non-ferrous metal workpiece as defined in claim 2, wherein:

said furnace comprises a Carburize furnace.

5. The method for treating a non-ferrous metal workpiece as defined in claim 4, wherein said heating step further comprises the step of:

heat soaking said workpiece within said Carburize furnace for a time period of approximately 10 minutes to approximately 3 hours.

6. The method for treating a non-ferrous metal workpiece as defined in claim 3, wherein:

said Carbon is introduced into said furnace at a concentration approximately between 0.10% and 0.85%.

7. The method for treating a non-ferrous metal workpiece as defined in claim 3, further comprising the step of:

purging the interior of the Carburize furnace by the introduction of a positive pressure of Nitrogen ($N_2$) gas before the Carbon is introduced.

8. An article formed in accordance with the method of claim 1, comprising:

said diffusion region is imbued with a logarithmic gradient of interstitial Carbon.

* * * * *